US006497061B1

(12) United States Patent
Aleksic et al.

(10) Patent No.: US 6,497,061 B1
(45) Date of Patent: Dec. 24, 2002

(54) IRONING BOARD COVER

(76) Inventors: Aleksandar Aleksic, 7 Hawson Ave., N. Plymouth, S.A. 5037 (AU); Vicky Vidovic, 139 Coombe Rd., Allenby Gardens, S.A. 5009 (AU)

( * ) Notice: Subject to any disclaimer, the term of this patent is extended or adjusted under 35 U.S.C. 154(b) by 0 days.

(21) Appl. No.: 09/830,545

(22) PCT Filed: May 11, 2000

(86) PCT No.: PCT/AU99/00701

§ 371 (c)(1),
(2), (4) Date: Apr. 27, 2001

(87) PCT Pub. No.: WO00/26462

PCT Pub. Date: May 11, 2000

(30) Foreign Application Priority Data

Oct. 30, 1998 (AU) ..... PP 6839

(51) Int. Cl.[7] ..... D06F 83/00
(52) U.S. Cl. ..... 38/140
(58) Field of Search ..... 38/140, 102, 137, 38/DIG. 2, 66

(56) References Cited

U.S. PATENT DOCUMENTS 989,962 A * 4/1911 Hall ..... 38/140
2,029,856 A * 2/1936 Collette ..... 38/140
2,035,245 A * 3/1936 Plotkin ..... 38/140
2,644,257 A * 7/1953 Emmett et al. ..... 38/140
3,007,267 A * 11/1961 Goldsmith ..... 38/140
4,557,062 A 12/1985 Mattesky
4,813,166 A 3/1989 Drake
4,982,516 A 1/1991 Cervantes
5,231,777 A 8/1993 Mattesky et al.
5,392,543 A 2/1995 Lehrman
6,233,854 B1 * 5/2001 Levy et al. ..... 38/140

FOREIGN PATENT DOCUMENTS

CA 2114783 8/1994

* cited by examiner

*Primary Examiner*—Ismael Izaguirre
(74) *Attorney, Agent, or Firm*—Sand & Sebolt

(57) ABSTRACT

An ironing board cover includes a plurality of sheets, the first of which extends over the surface and periphery of the ironing board table and the second of which extends underneath the table. The second sheet is elastic (suitably made of synthetic materials such as those used in wetsuits, where the material is homogeneous in its resilience in all directions) and thereby provides a tensioning force on the sheet to keep the cover taut over the ironing board table. The second sheet may be additionally secured under the table or may extend wholly underneath the table with appropriate openings for the legs of the ironing board to not only extend therethrough but be foldable to a storage position.

24 Claims, 7 Drawing Sheets

IRONING BOARD COVER

The present invention relates to an ironing board cover and in particular to an ironing board cover including a tensioning means to assist in keeping the cover taut over an ironing board.

BACKGROUND OF THE INVENTION

Domestic ironing boards generally include an ironing table mounted on a pair of pivoting legs that adjust the height of the table. The ironing table also includes a pad to assist in dissipating the heat from an iron, the pad itself covered by a suitable material cover. This cover usually not only extends over the surface of the table but also extends around the periphery of the table. A drawstring or an elastic binding is known to be used around the periphery to assist in keeping the cover in place. The problem with these is that they are not very effective in keeping the cover taut across the table especially in the longitudinal direction. Through use the cover generally moves or rotates requiring continuos adjustment.

It is an object of the present invention to provide an ironing board cover which overcomes some of the above-mentioned problems or at least provides the public with a useful alternative.

SUMMARY OF THE INVENTION

Therefore, in one form of the invention though this need not be the only or indeed the broadest form there is proposed an ironing board cover for an ironing board having an ironing table, said cover including;

a first sheet adapted to extend over said ironing table; and a second elastic sheet secured to said first sheet adapted to extend at least partially under said ironing table to provide tension to the first sheet across said ironing surface.

Preferably said second sheet is secured to the periphery of said first sheet.

Preferably said second sheet is adapted to extend substantially underneath said table.

Preferably said second sheet includes a slit or placket to enable the cover to be fitted over legs supporting said table.

Preferably said slit is closable slit by the use of a fastener means.

Preferably said fastener is a zipper.

Preferably said second sheet extends substantially underneath said table.

In a further form of the invention there is proposed an ironing board cover for covering an ironing table, said cover including a substantially elastic sheet adapted to extend at least partially under said table to thereby provide a tension effect for the portion of the cover extending over said table.

Preferably said second sheet extends substantially underneath said table.

Preferably said second sheet further includes a plurality of apertures adapted to allow for the legs of the ironing board to extend therethrough.

In a still further form of the invention there is proposed an ironing board cover for an ironing board having an ironing table, said cover extending over the surface of said table and at least partially underneath said table, said cover including a plurality of sheets secured together, at least some of said sheets being elastic, and wherein said sheets are secured to each other in an arrangement so as to maintain lateral separation of each elastic sheet.

BRIEF DESCRIPTION OF THE DRAWINGS

To further assist in understanding the invention reference is made to the following drawings in which.

DESCRIPTION OF THE PREFERRED EMBODIMENTS

Figure 1:
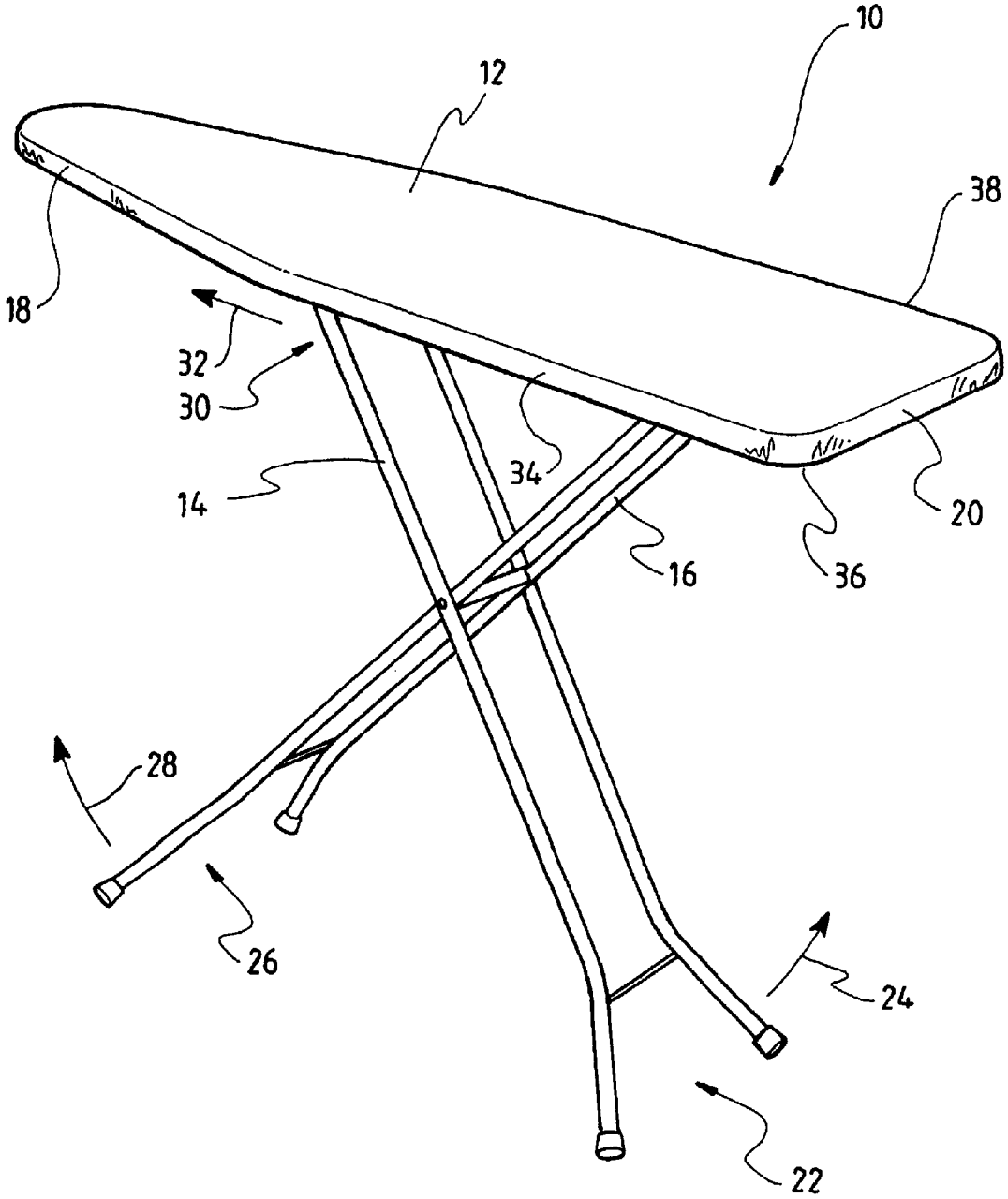
FIG. 1 is a perspective view of a typical ironing board with twin with a cover.

Referring to the figures there is shown in FIG. 1 an ironing board 10 of a conventional construction includes an ironing table or surface 12 supported by a pair of pivoted leg assemblies 14 and 16. The ironing table extends longitudinally from a tapered end or nose 18 to the other end or heel 20. The leg assembly 14 is pivotably engaged to the ironing board at a position nearer the nose 18, while leg assembly 16 is slidably engaged to the ironing board nearer the heel 20. The ironing board is adapted to be folded to a stored position in which the leg assemblies assume a position substantially flush against the underside of the table or surface 12. To achieve this, the outer end 22 of leg assembly 14 is folded upwards in direction 24 whilst the outer end 26 of leg assembly 16 is folded upwards in direction 28. Since the leg assembly 16 is pivotably fixed to the heel end 20, this folding action causes the inner end 30 of the leg assembly 14 to slide towards the nose in direction 32.

The ironing table 12 includes a peripheral edge 34 usually of an 'L' shape. Located on the underside 36 of the table 12 are various supporting structures that may include support rails (not shown) that enable the table to be used for ironing purposes. Generally an ironing board cover 38 extends across the top surface of the table 12, around the peripheral edge 34 with the edge of the cover 38 located close to the proximity of the 'L' shaped peripheral edge 34. A drawstring or the like (not shown) is known to extend around the edge of the cover 38 which is then drawn together to thus keep the cover in place over the table. It is also known to place a layer of material (not shown) between the table and the cover so as to provide a better ironing surface.

Figure 2:
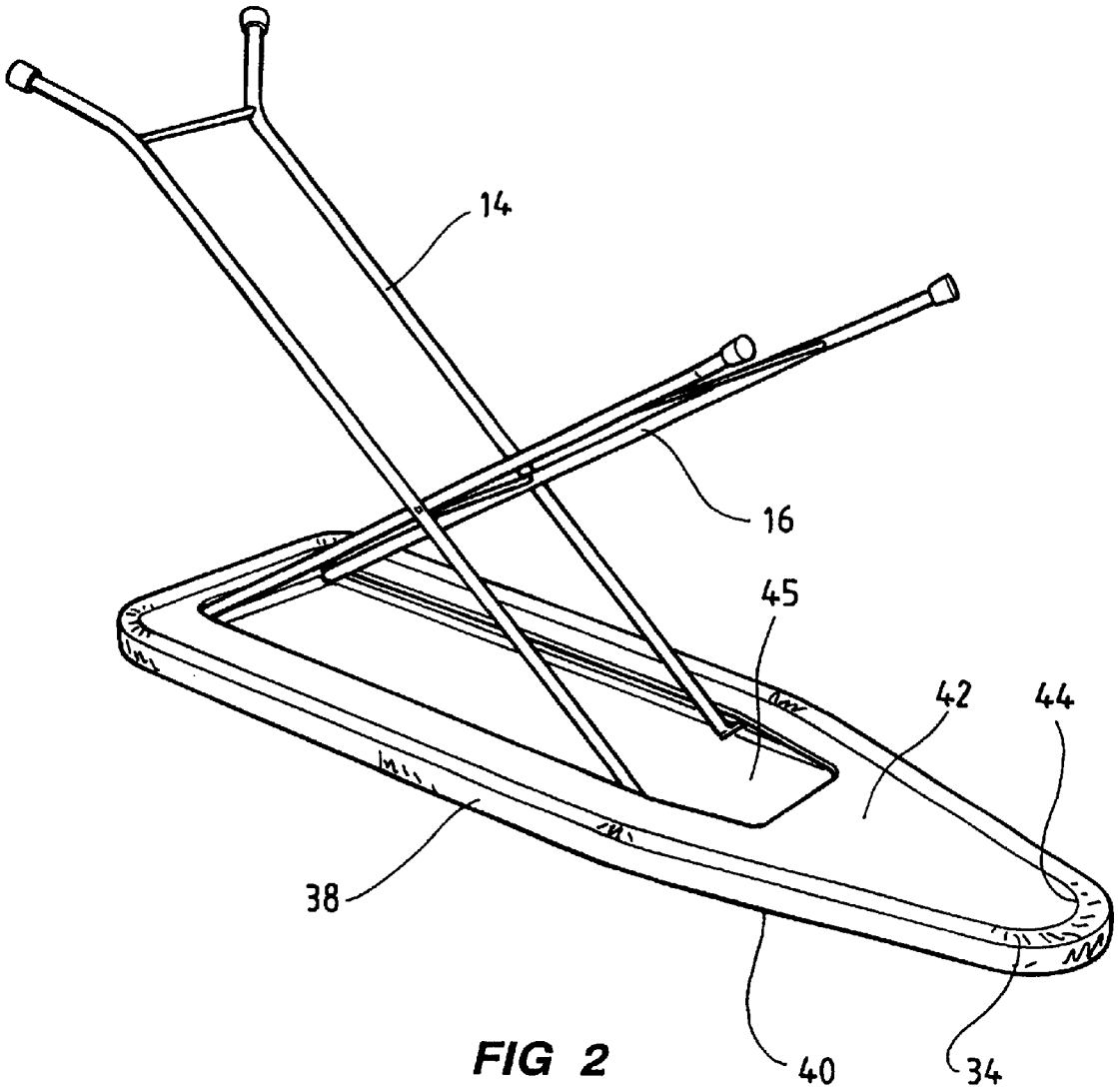
FIG. 2 is a perspective view of the underside of an ironing board, illustrating an ironing board cover according to a first embodiment of the present invention.

According to a first embodiment of the invention as illustrated in FIG. 2, the cover 38 includes a first sheet 40 extending over the upper surface of table 12 around the edge 34, and a second sheet 42 extending partially underneath the table 12 and secured by appropriate means (such as stitching) to the peripheral edge 44 of the first sheet 40. The second sheet is manufactured from an elastic material to provide a tensioning force to the first sheet 40 and thus keep it taut over the ironing table 12. Suitable materials may include synthetic materials such as those used in wetsuits, where the material is homogeneous in its resilience in all directions. An opening 45 in the second sheet allows the cover to be fitted over the table and for the legs 14 to slidably move along the underside of the table from a storage to a working position. It has been found that even a relatively small surface area of the elastic material provides sufficient tensioning to keep the cover taut in place. Although the elastic material generally has to extend substantially around the periphery of the first sheet constructions where the second sheet is made in part from an elastic material are envisaged in the present invention.

Figure 3A:
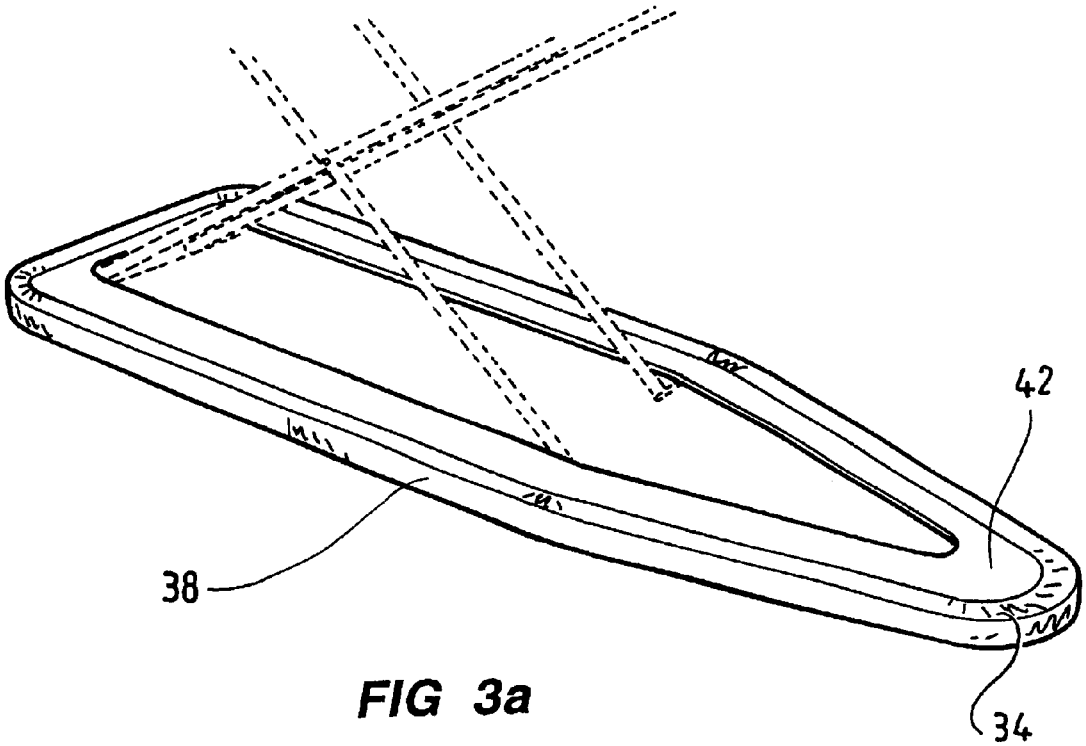
FIG. 3(*a*) is a perspective view of the underside of an ironing board illustrating an ironing board cover according to a second embodiment of the invention; and (*b*) is a perspective view of the cover as in (*a*) with further tensioning attachments.
Figure 3B:
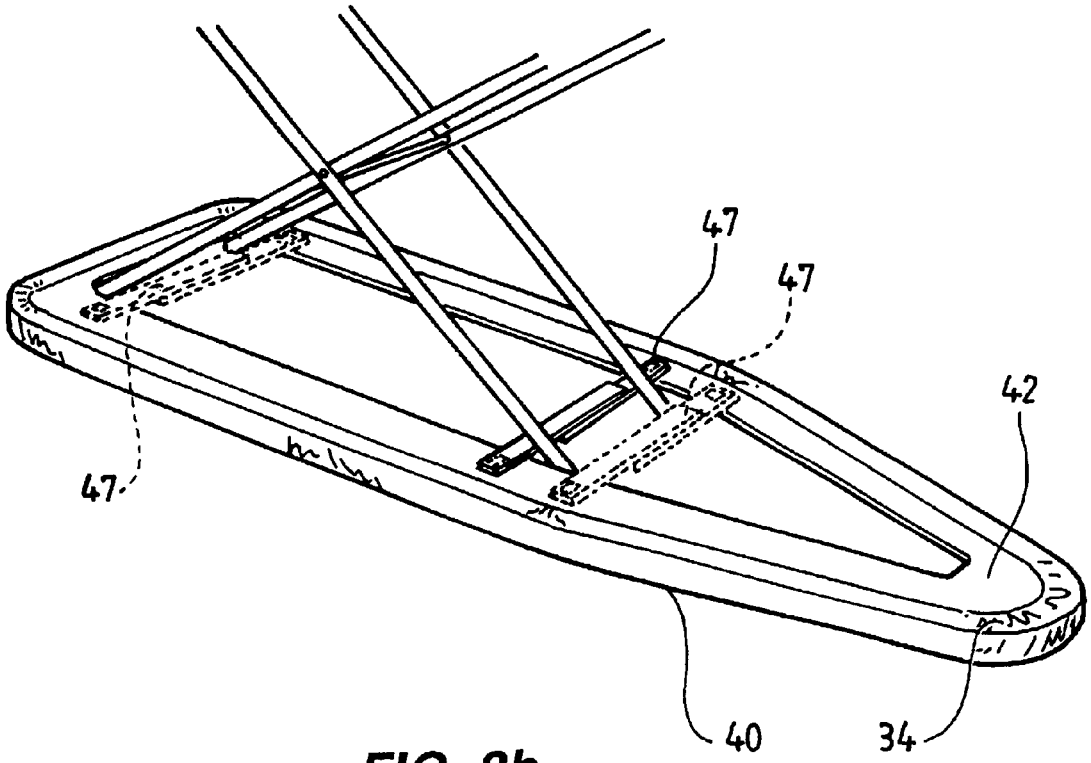

Turning now to FIGS. 3(*a*) and (*b*), it has been found that reducing the total area of the elastic sheet on the nose portion of the underside of the table does not significantly affect the performance of the cover. Thus, instead of a larger underside nose areas as in FIG. 2, in the second embodiment, the elastic material is essentially a constant width around the periphery of the first sheet. Further assistance in keeping the cover taut may be obtained form the use of straps 47 as shown in FIG. 3(*b*) and which straddle across the width of the ironing board from their longitudinal sides. These straps can be secured by the use of studs, or hook material fasteners as are commonly known under the trade mark Velcro.

Figure 4:
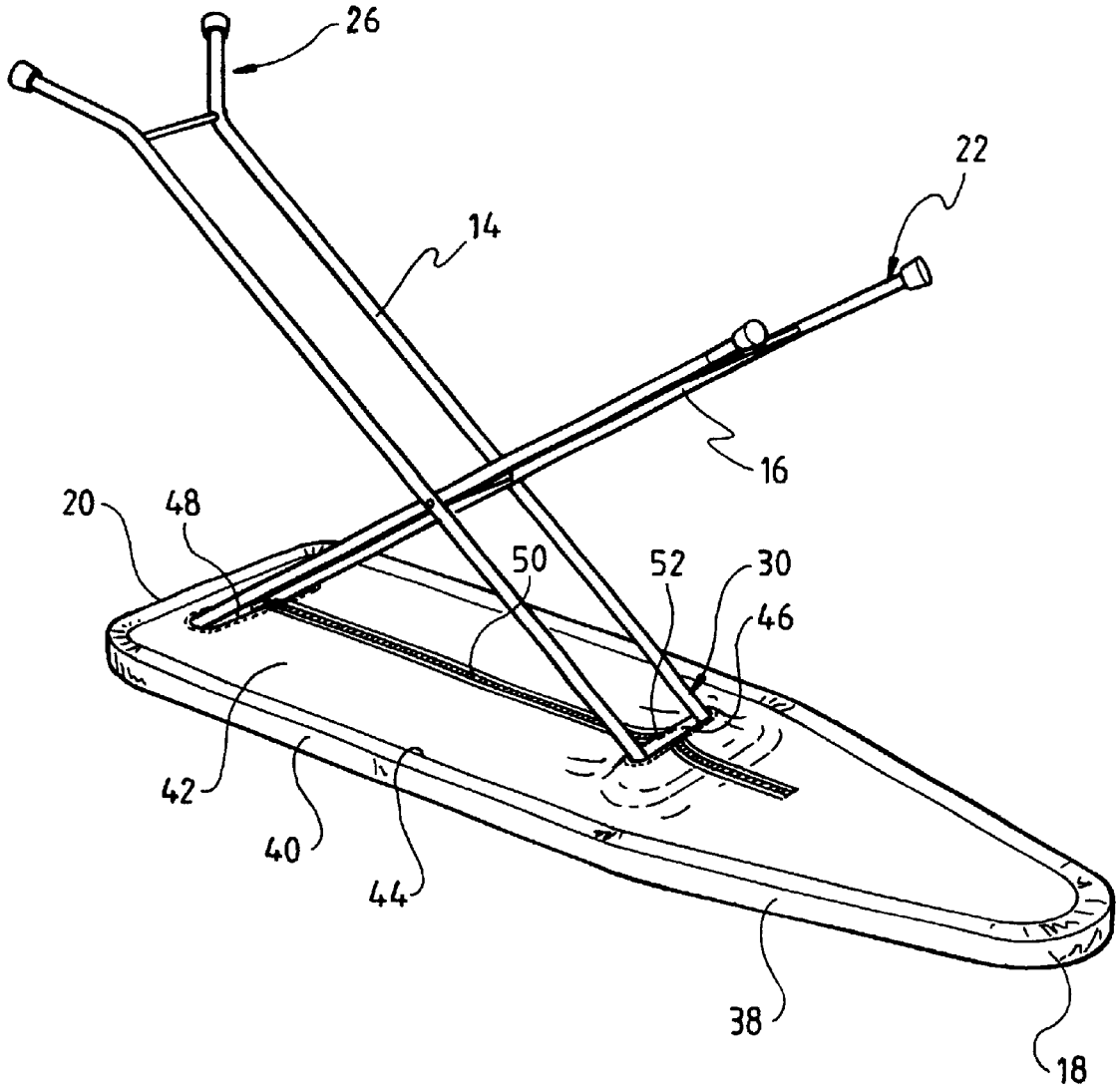
FIG. 4 is a perspective view of the underside of an ironing board illustrating a cover according to a third embodiment and including a zip to assist in the tensioning of said cover.

To maximise the tensioning force and provide a neat appearance one may maximise the total surface area of the second sheet by having it extend substantially underneath the board, this exhibited in FIG. 4. The second sheet 42 includes two longitudinal slits or openings 46 and 48 allowing the leg assemblies 14 and 16 to pass therethrough. Extending between the two openings is a closable slit 50 that allows the cover to be folded laterally outwards to enable it to be fitted onto the table. Being closable by an appropriate means, such as zipper 52, allows the second sheet to maintain its resilience and thus to keep the cover taut over the ironing table. Since the second sheet is made from a resilient material, when the leg assemblies are being folded, the second sheet around the opening 46 stretches to accommodate the inner end 30 of leg assembly 14 sliding towards the nose 18.

Figure 5:
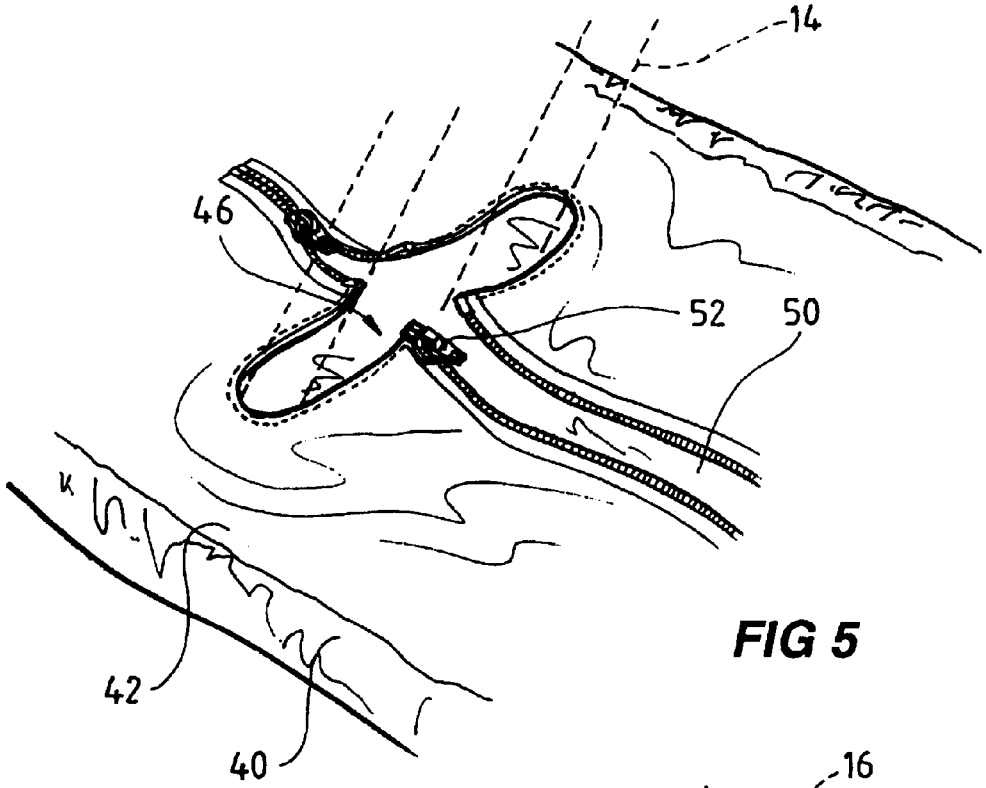
FIG. 5 is a partial perspective view of one end of the ironing board cover of FIG. 4.
Figure 6:
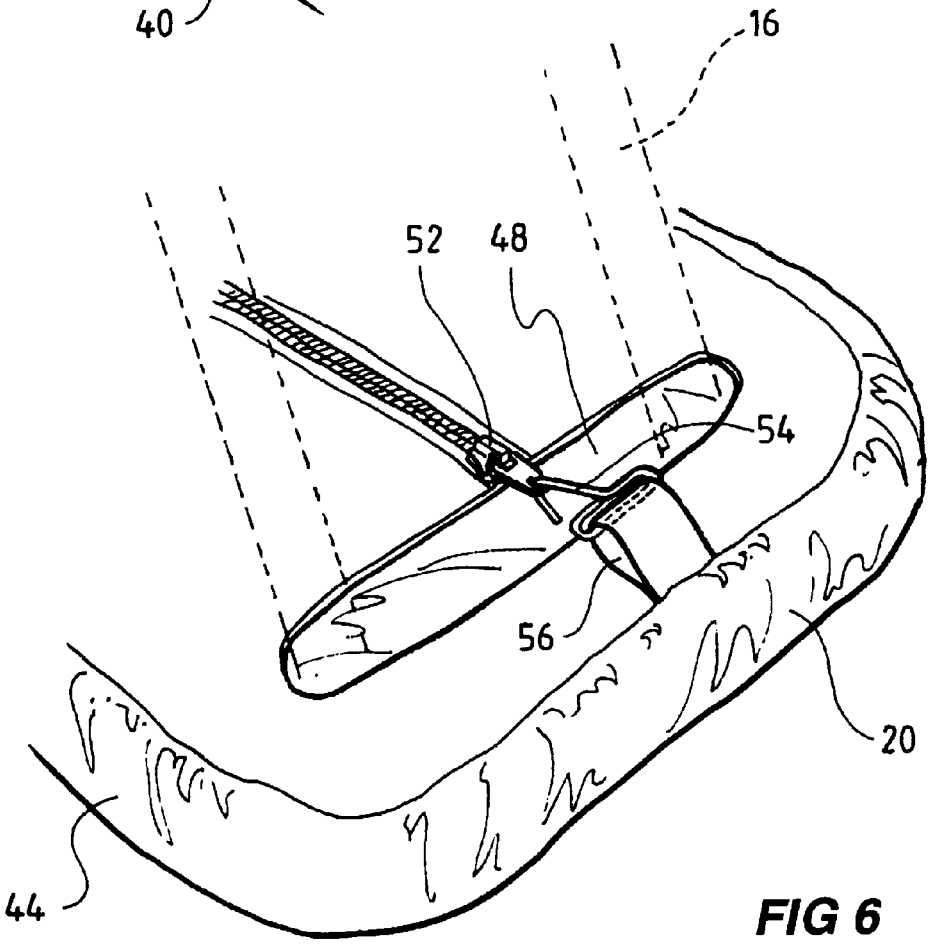
FIG. 6 is a partial perspective view the other end of the ironing board cover of FIG. 4.

FIGS. 5 and 6 illustrate in more detail the structure of the second sheet around the openings 46 and 48. When the cover is being fitted onto the ironing table the zipper 52 is completely undone allowing the cover to be fitted onto the table. When the cover has been fitted onto the table the zipper 52 is then used to close slit 50 to ensure that the fit is tight and that the resulting tension extending underneath the table keeps the cover taut. Referring to FIG. 6, a hook 54 may be attached to the zipper and to strap 56 which is fixed to the periphery of the first sheet ensuring that the opening 48 substantially retains its shape. It also may assist in locating the zipper in place although the zipper is preferably of a construction that is self-locking.

Figure 7:
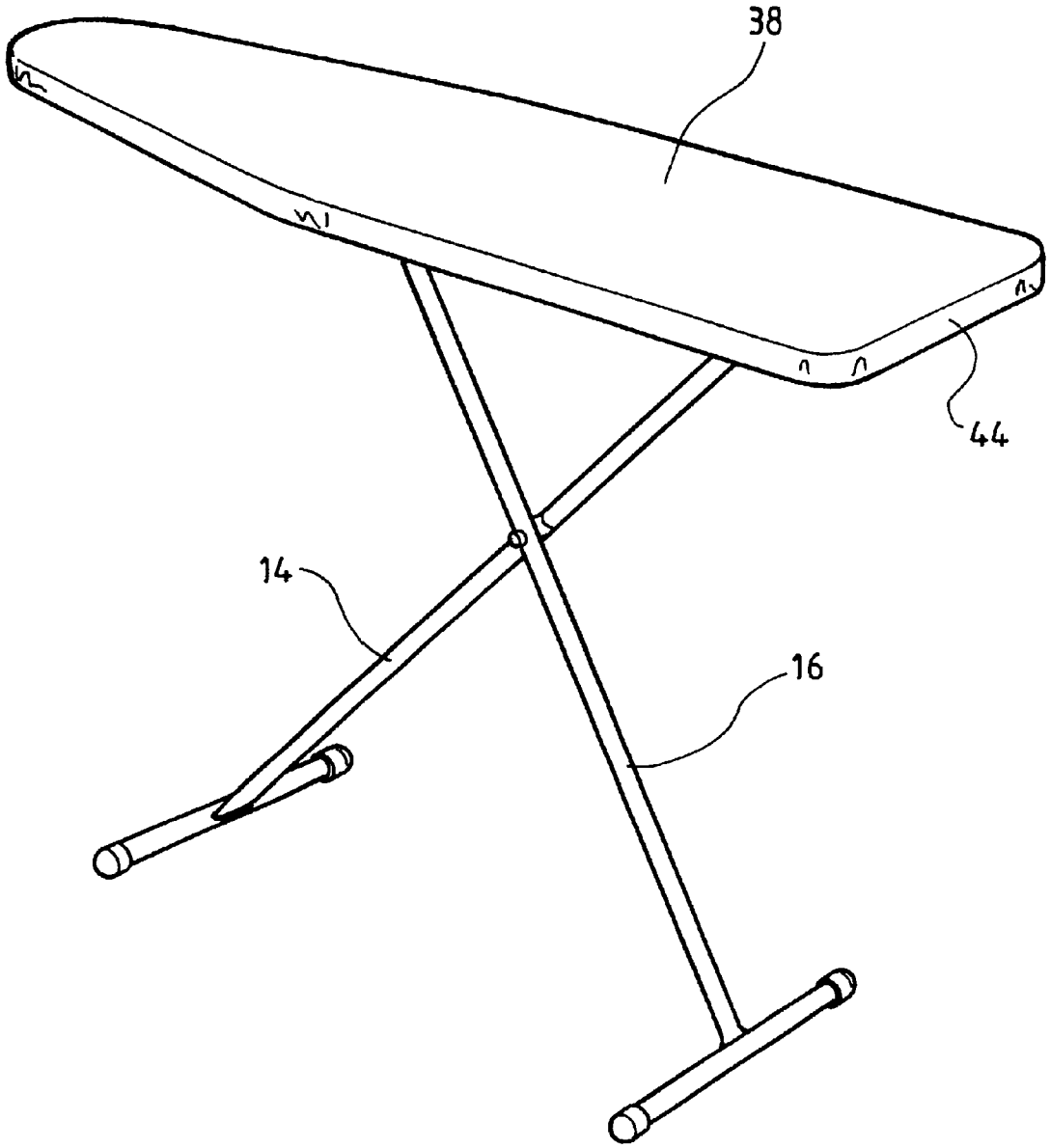
FIG. 7 is a perspective view of an ironing board having single pivotable legs and a cover according to yet another embodiment of the invention.
Figure 8:
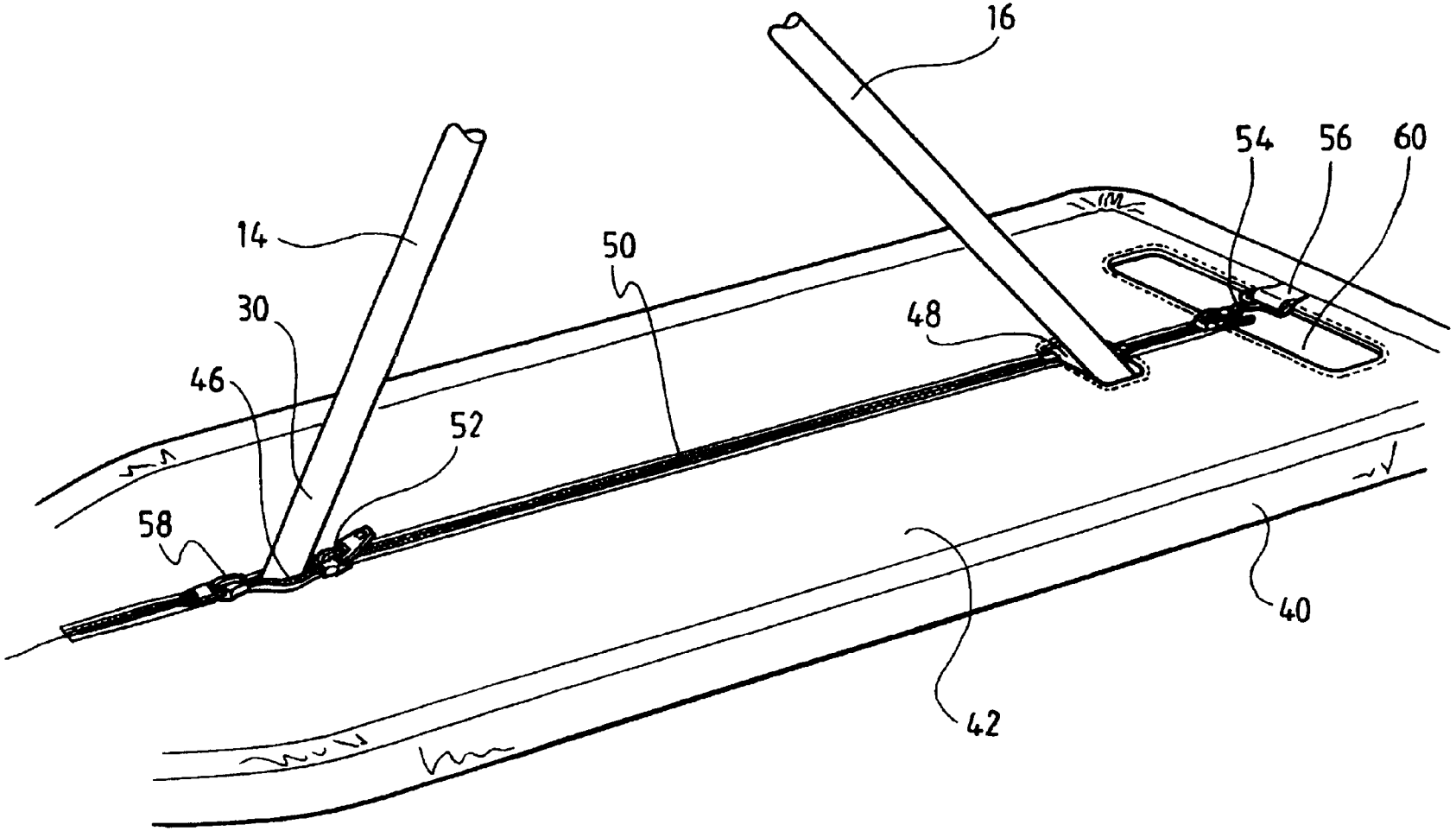
FIG. 8 is a partial perspective underside view of the cover of FIG. 7.

Referring now to FIGS. 7 and 8 there is illustrated yet a further embodiment of the invention to suit ironing boards whose leg assemblies are of a single tubular construction. The openings 46 and 48 thus do not need to be as wide as those shown in the first embodiment. In addition, opening 46 can be closable by the use of two zips, 52 and 58, both closing slit 50 and defining between them opening 46 through which extends the leg assembly 14. This enables the leg assembly 14 to slidably move underneath the board whilst keeping the slit closed, except for the aperture between the two slits, this ensuring that the tension on the second sheet is maintained. This moveable opening thus allows the table to be adjusted in height whilst ensuring that the second sheet 42 and thus the cover remains taut. Opening 48 is still of a wider construction than the width of the leg assembly to allow for the two leg assemblies to both coexist in that opening when the table is in the stored position. The cover may include other features that are not essential to the invention but provide additional assisting features. For example, the cover may include opening 60 allowing an iron holder to extend from the table.

Further improvements to the invention may be the use of different types of elastic materials, such as ones where the elasticity is in one-dimension only, for example in the weft rather than the warp direction or vice versa.

It is to be understood that throughout the specification the intention has been to illustrate the invention and not to limit it thus. Other embodiments and variation to the invention may be performed by the person skilled in the art without deviating from the scope and spirit of the invention. The purpose of the description has thus been to illustrate the invention and not to limit it thus.

What is claimed is:

1. An ironing board cover for an ironing board having an ironing table, said cover including:

a first sheet adapted to extend over said ironing table; and a second elastic sheet secured to said first sheet and adapted to extend substantially underneath said ironing table, the second sheet being elastic in all directions to provide tension to the first sheet across said ironing surface.

2. An ironing board cover as in claim 1 wherein said second sheet is secured to the periphery of said first sheet.

3. An ironing board cover as in claim 1 wherein said second sheet includes a slit or placket to enable the cover to be fitted over legs supporting said table.

4. An ironing board cover as in claim 3 wherein said slit is closable slit by the use of a fastener means.

5. An ironing board cover as in claim 4 wherein said fastener is a zipper.

6. An ironing board cover as in claim 5, further comprising a zipper securing means disposed on the first sheet and adapted for engagement with the zipper.

7. An ironing board cover as in claim 6, wherein the zipper has a pull tab with an eye disposed therein and the zipper securing means is a hook adapted to engage in the eye of the zipper.

8. An ironing board cover as in claim 7, wherein the hook is secured to the first sheet by way of a strap.

9. An ironing board cover for covering an ironing table, said cover including a substantially elastic sheet adapted to extend substantially underneath said table, the sheet being elastic in all directions to thereby provide a tension effect for the portion of the cover extending over said table.

10. An ironing board cover as in claim 9, wherein the part of the cover that extends under the table further includes a plurality of apertures adapted to allow for the legs of the ironing board to extend therethrough.

11. An ironing board cover as in claim 9, wherein the elastic sheet extends underneath substantially all of the table.

12. An ironing board cover for covering an ironing board having an ironing table, said cover including;

a first sheet adapted to extend over said ironing table; and a second elastic sheet secured to said first sheet and adapted to extend substantially underneath said table to provide tension to the first sheet across said ironing surface; said second sheet including a plurality of apertures adapted to allow for the legs of the ironing board to extend therethrough.

13. An ironing board cover as in claim 12, wherein the second sheet is elastic in all directions.

14. An ironing board cover as in claim 12, wherein the second sheet extends underneath substantially all of the table.

15. An ironing board cover for an ironing board having an ironing table, said cover extending over the surface of said table and substantially underneath said table, said cover including a plurality of sheets secured together, at least some of said sheets being elastic in all directions, and wherein said sheets are secured to each other in an arrangement so as to maintain lateral separation of each elastic sheet.

16. An ironing board cover as in claim 15, wherein the part of the cover that extends under the table further includes a plurality of apertures adapted to allow for the legs of the ironing board to extend therethrough.

17. An ironing board cover as in claim 15, wherein the cover extends underneath substantially all of the table.

18. An ironing board cover for an ironing board having an ironing table and adjustable legs attached thereto, the ironing board having a longitudinal length, said cover including:

a first sheet adapted to extend over said ironing table; and a second elastic sheet secured to said first sheet and adapted to extend under substantially all of said ironing table, said second sheet being elastic in all directions with respect to the longitudinal length to provide tensile forces to the first sheet across said ironing surface; the tensile forces being disposed through the first sheet along the entire longitudinal length of the ironing board.

19. An ironing board cover as in claim 18, wherein the second sheet further includes a plurality of apertures adapted to allow for the legs of the ironing board to extend therethrough.

20. An ironing board cover as in claim 19, further comprising a fastener means proximate the apertures to provide additional tension to the cover.

21. An ironing board cover as in claim 20, further comprising a fastener securing means disposed on the first sheet and adapted for engagement with the fastener means to maintain the tensile forces through the first sheet.

22. An ironing board cover as in claim 21, wherein the fastener means is a zipper.

23. An ironing board cover as in claim 22, wherein the zipper has a pull tab with an eye disposed therein and the fastener securing means is a hook adapted to engage in the eye of the zipper.

24. An ironing board cover as in claim 23, wherein the hook is secured to the first sheet by way of a strap.

* * * * *